US008882544B2

(12) United States Patent
Komoto et al.

(10) Patent No.: US 8,882,544 B2
(45) Date of Patent: Nov. 11, 2014

(54) CONNECTOR

(71) Applicant: Japan Aviation Electronics Industry, Ltd., Tokyo (JP)

(72) Inventors: Tetsuya Komoto, Tokyo (JP); Osamu Hashiguchi, Tokyo (JP); Takuya Takahashi, Tokyo (JP); Ryuzo Shimeno, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 27 days.

(21) Appl. No.: 13/689,367

(22) Filed: Nov. 29, 2012

(65) Prior Publication Data

US 2013/0137305 A1 May 30, 2013

(30) Foreign Application Priority Data

Nov. 30, 2011 (JP) ..... 2011-261304

(51) Int. Cl.

| | |
|---|---|
| ***H01R 24/00*** | (2011.01) |
| ***H01R 12/73*** | (2011.01) |
| ***H01R 13/46*** | (2006.01) |
| *H01R 12/57* | (2011.01) |

(52) U.S. Cl.

CPC ..... *H01R 13/46* (2013.01); *H01R 12/73* (2013.01); *H01R 12/57* (2013.01)

USPC ..... 439/626

(58) Field of Classification Search

CPC ..... H01R 13/2442

USPC ..... 439/626, 660, 566, 570, 74

See application file for complete search history.

(56) References Cited

U.S. PATENT DOCUMENTS 5,499,924 A * 3/1996 Arisaka et al. ..... 439/67
7,153,164 B2 * 12/2006 Farnworth et al. ..... 439/630

FOREIGN PATENT DOCUMENTS

JP 2006-228612 A 8/2006
JP 2007-287394 A 11/2007
JP 2007299617 A 11/2007

OTHER PUBLICATIONS

Korean Office Action dated Oct. 23, 2013 in Korean Patent Application No. 10-2012-0124840.
Korean Office Action issued on Apr. 23, 2014 in corresponding Korean application.

* cited by examiner

*Primary Examiner* — Phuongchi T Nguyen
(74) *Attorney, Agent, or Firm* — Maier & Maier, PLLC

(57) ABSTRACT

Provided is a connector that can be firmly mounted on the substrate. A plug connector is mounted on a plug substrate while making a metal plate function as a plurality of contacts by an insulting layer formed on the metal plate and a plurality of conductive patterns formed on the insulating layer. A plurality of protrusions that protrude toward the plug substrate are formed on a substrate opposing surface, which is a surface opposite to the plug substrate. The plurality of conductive patterns are formed to respectively overlap the plurality of protrusions.

6 Claims, 14 Drawing Sheets

RELATED ART

CONNECTOR

RELATED APPLICATIONS

This application claims priority under 35 U.S.C. §119 to Japanese Patent Application No. 2011-261304, filed Nov. 30, 2011, the disclosure of which is incorporated by reference herein in its entirety.

BACKGROUND OF THE INVENTION

1. Field of the Invention

The present invention relates to a connector.

2. Description of Related Art

As shown in FIG. 14 of the present invention, Japanese Patent Application Publication No. 2006-228612 discloses a connector 101 with a conductor part composed of an insulating layer formed on one surface of a base material 100, which is a metal plate, and metal plating formed on the insulating layer. This connector 101 is attached to a printed circuit board 102 by mounting a bottom part 100a of the base material 100 on the printed circuit board 102.

However, there has been a room for improvement in the connector disclosed in Japanese Unexamined Patent Application Publication No. 2006-228612 in regard to mounting on the substrate.

An object of the present invention is to provide a connector that can be firmly mounted on a substrate.

SUMMARY OF THE INVENTION

A first exemplary aspect of the present invention is a connector that is mounted on a substrate while making a metal plate function as a plurality of contacts by an insulating layer formed on the metal plate and a plurality of conductive patterns formed on the insulating layer. The connector includes a protrusion that protrudes toward the substrate on a substrate opposing surface opposite to the metal plate, in which the substrate opposing surface is opposite to the substrate. Any one of the plurality of the conductive patterns is formed to overlap the protrusion.

Preferably, the protrusion protrudes in a substantially spherical shape.

Preferably, a top part of the protrusion is formed to be substantially flat.

Preferably, the substrate opposing surface is coated to be insulated except for the protrusion.

Preferably, a plurality of the protrusions are formed, and the plurality of protrusions are arranged in a staggered pattern.

A second exemplary aspect of the present invention is a connector that is mounted on a substrate while making a metal plate function as a plurality of contacts by an insulating layer formed on the metal plate and a plurality of conductive patterns formed on the insulating layer. The connector includes a plurality of protrusions that protrude toward the substrate on a substrate opposing surface of the metal plate, in which the substrate opposing surface is opposite to the substrate. The plurality of conductive patterns are formed to respectively overlap the plurality of protrusions.

Preferably, the substrate opposing surface is coated to be insulated except for the plurality of protrusions.

Preferably, the plurality of bugled parts are arranged in a staggered pattern.

According to the present invention, a connection part protruding from the flat substrate opposing surface on the flat surface enables firm mounting on the substrate by preventing the connection part from being buried in the thickness of an insulating coating added to the opposing surface and also generating a gap between the substrate surface and thereby suppressing the solder bridge. This further prevents short-circuit between the plurality of conductive patterns and achieves narrow-pitch mounting.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

A first exemplary embodiment of the present invention according to the present invention is explained with reference to FIGS. 1 to 11. In each drawing, fine hatching applied on the surface except the cross-section surface is an image of conductive patterns.

(Connector Unit 1)

Figure 1:
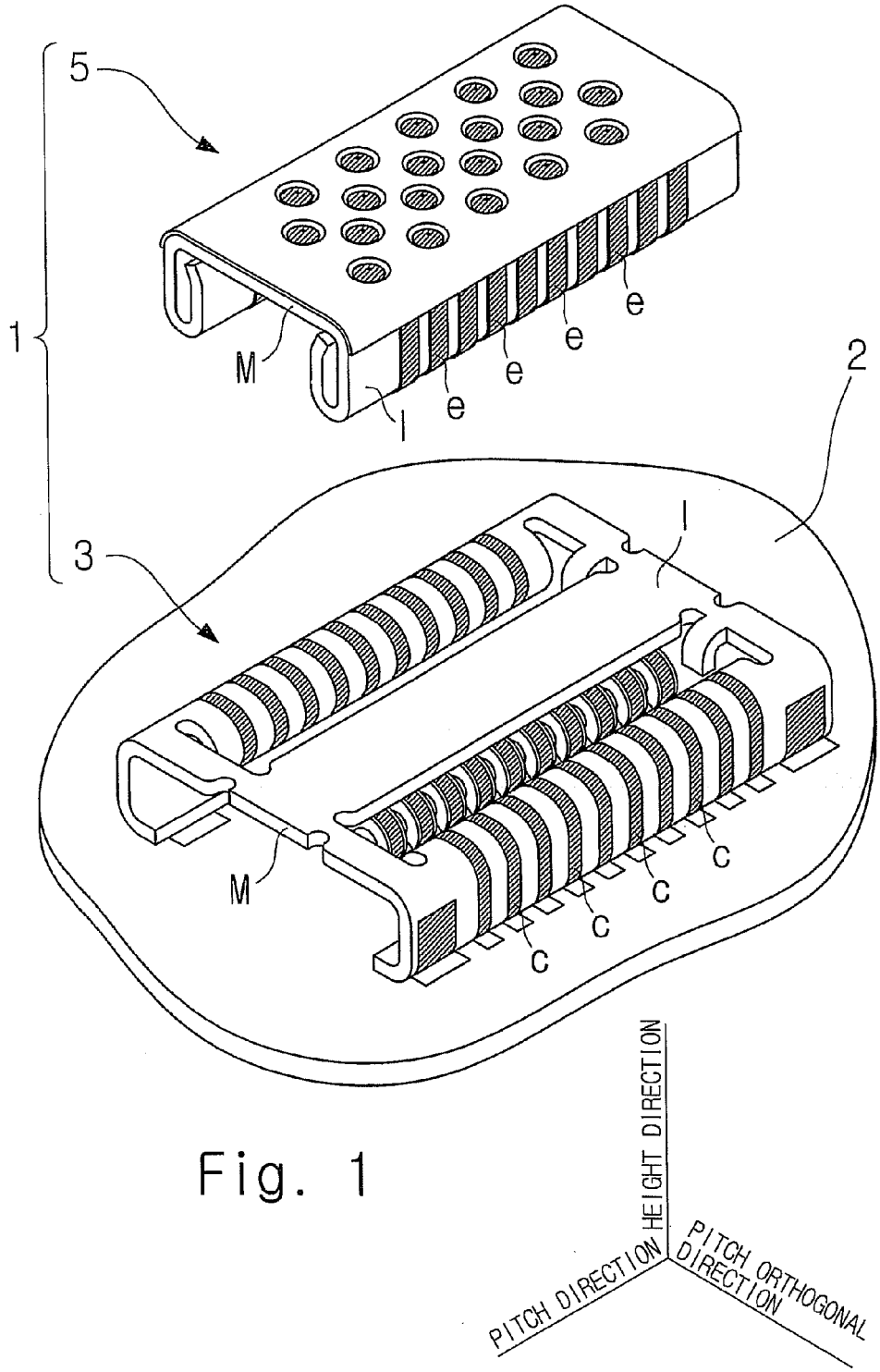
FIG. 1 is a perspective view of a state when a plug connector is removed from a receptacle connector according to a first exemplary embodiment.
Figure 10:
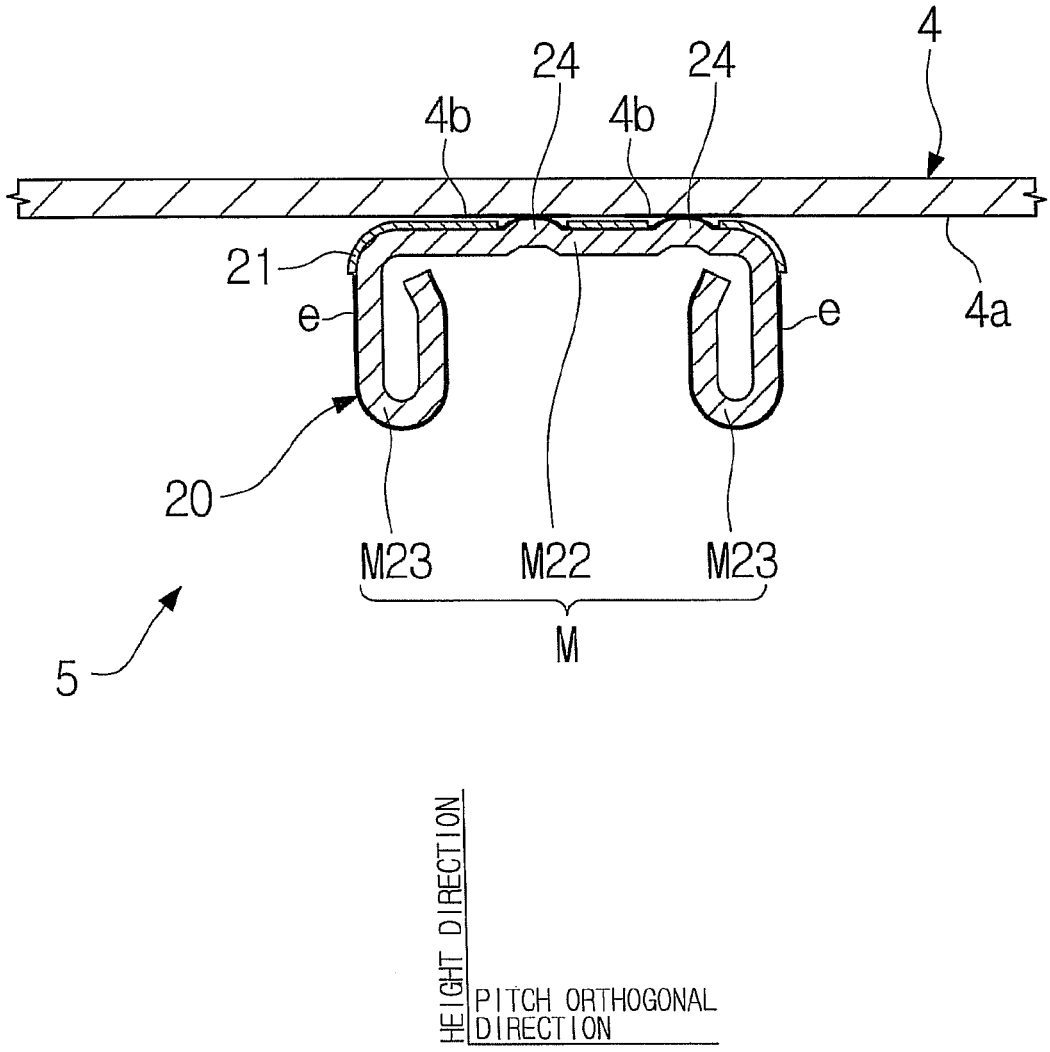
FIG. 10 is a cross-sectional diagram of the plug connector attached to a plug substrate according to the first exemplary embodiment.
Figure 11:
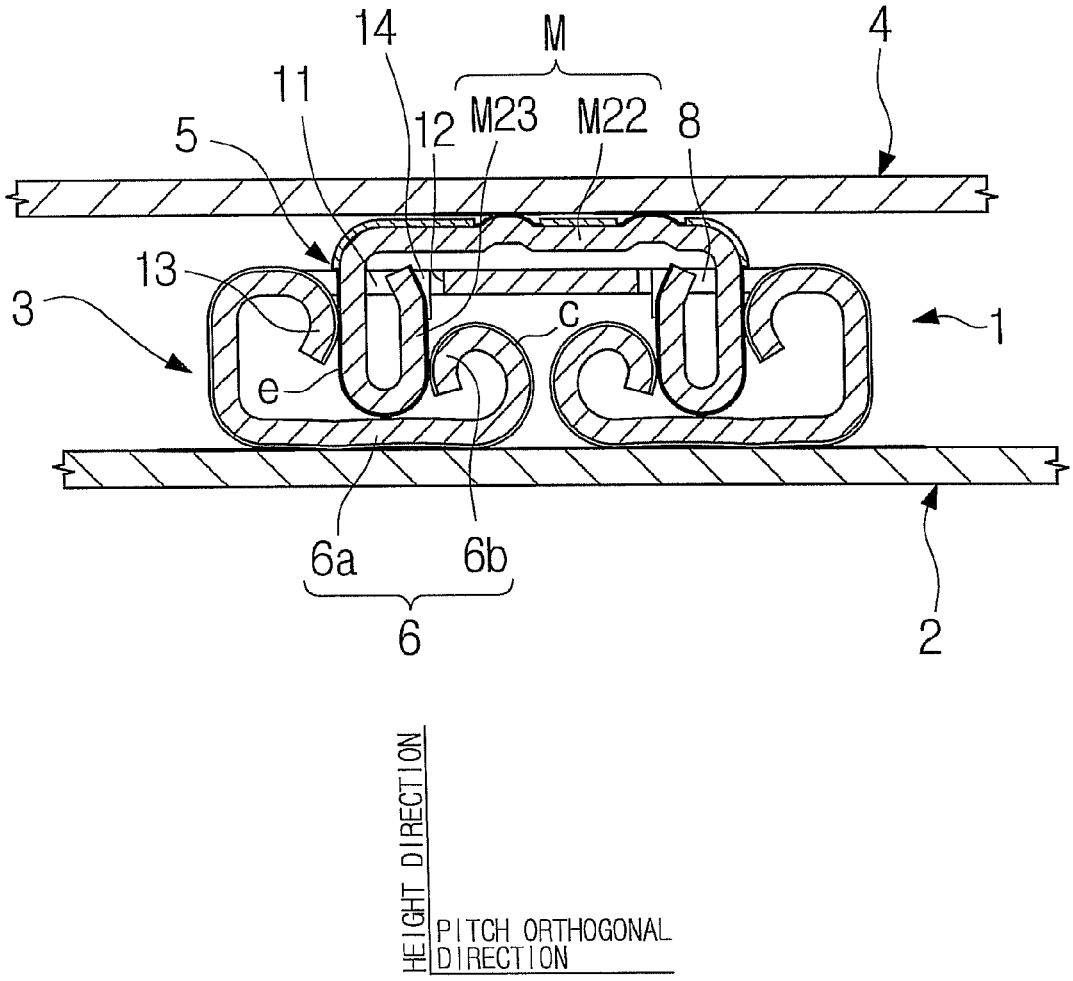
FIG. 11 is a cross-sectional diagram showing a mated state of the receptacle connector and the plug connector according to the first exemplary embodiment.

As shown in FIG. 1, a connector unit 1 is composed of a receptacle connector 3 (a first connector, a first housingless connector) that is mounted on a receptacle substrate 2 (a first substrate) and a plug connector 5 (a connector, a second connector, a second housingless connector) that is mounted on a plug substrate 4 (a substrate, a second substrate, see also FIG. 10). As shown in FIG. 11, the plug connector 5 is mated with the receptacle connector 3 so as to electrically connect the receptacle substrate 2 and the plug substrate 4.

As shown in FIG. 1, in the receptacle connector 3, a metal plate M functions as a plurality of contacts by an insulating layer I formed on the metal plate M and a plurality of conductive patterns c formed on the insulating layer I. In this exemplary embodiment, the receptacle connector 3 is formed as a so-called housingless connector not including a resin housing.

(Receptacle Connector 3)

Figure 2:
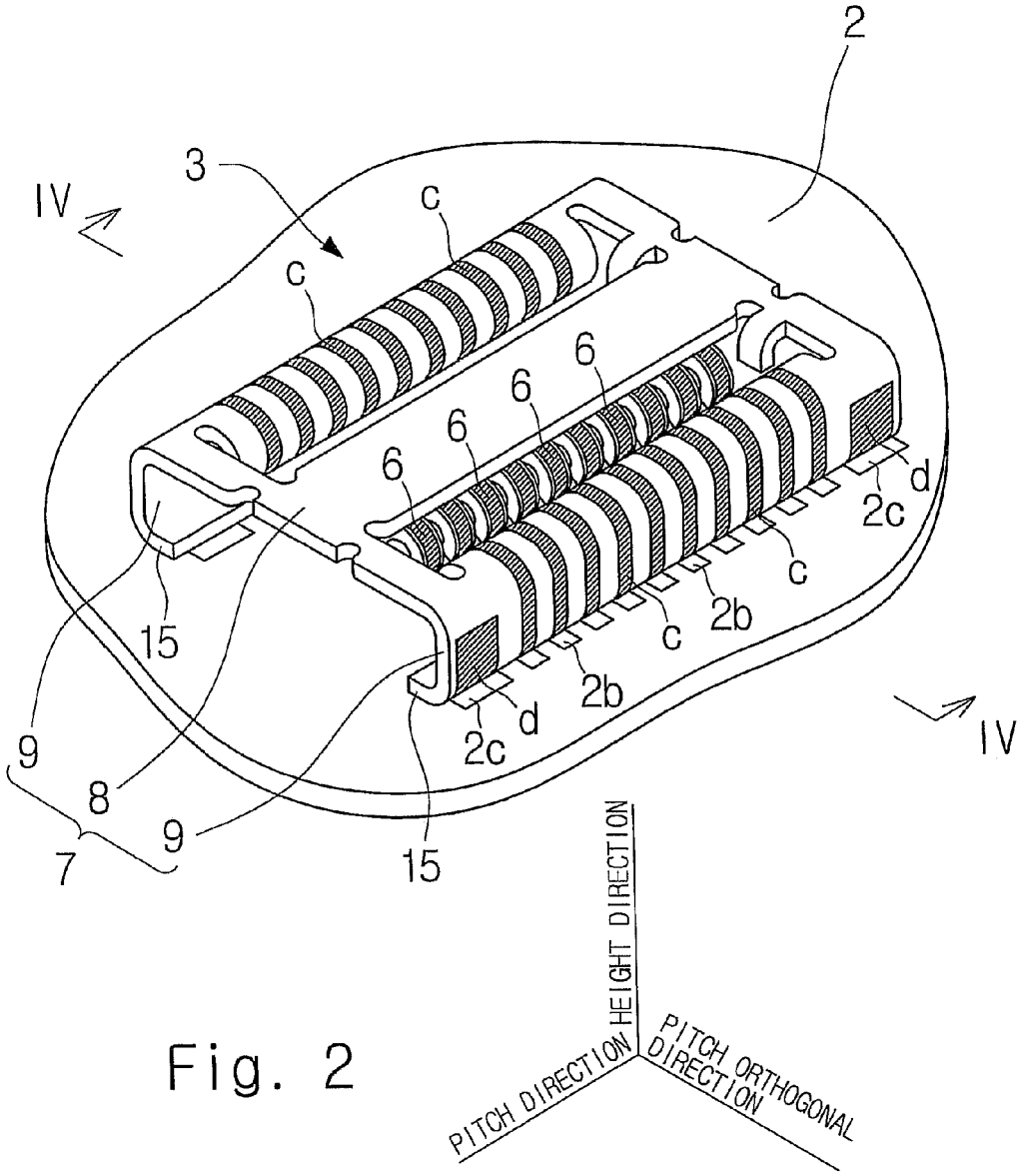
FIG. 2 is a perspective view of the receptacle connector according to the first exemplary embodiment.
Figure 3:
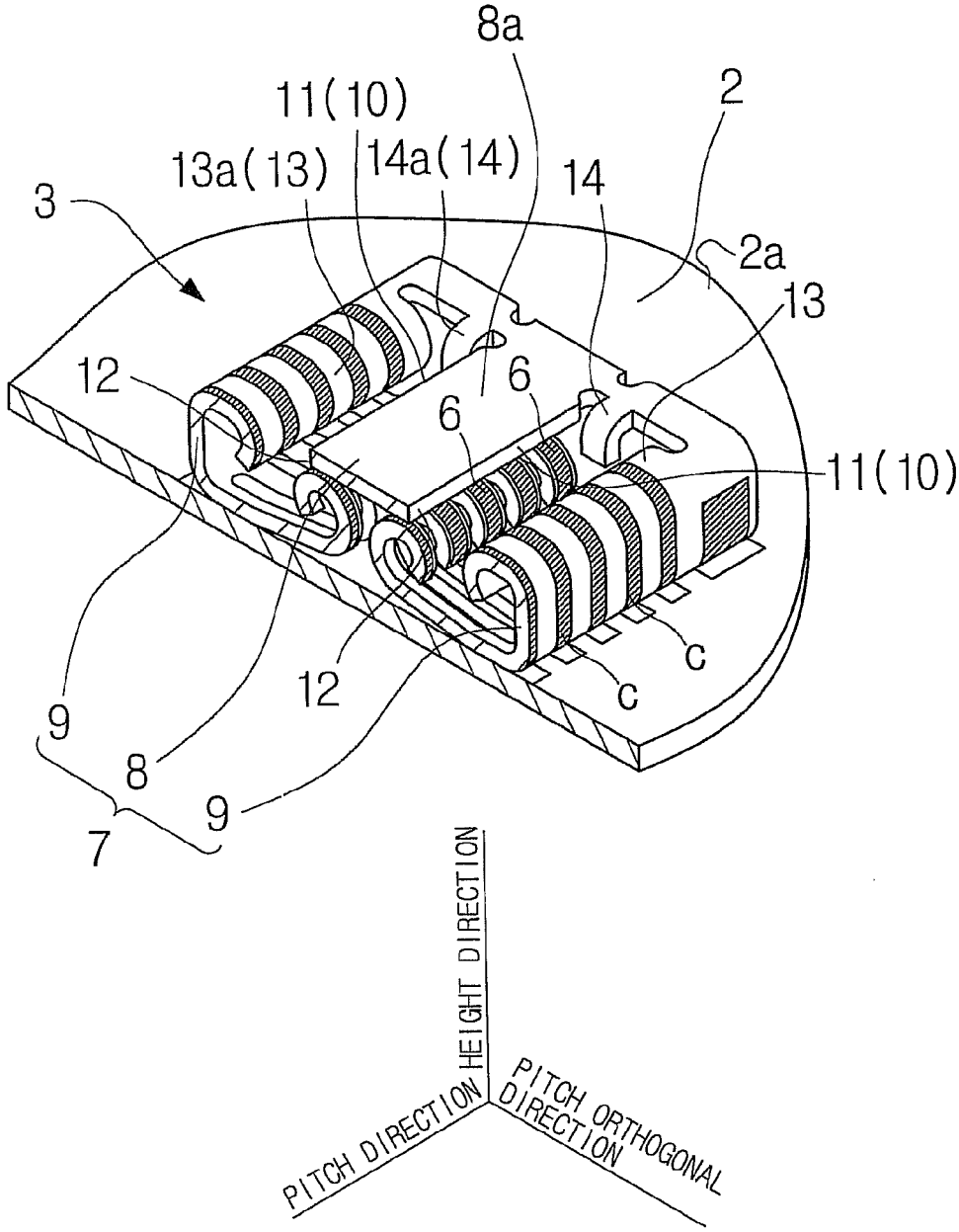
FIG. 3 is a partially cutaway perspective view of the receptacle connector according to the first exemplary embodiment.
Figure 4:
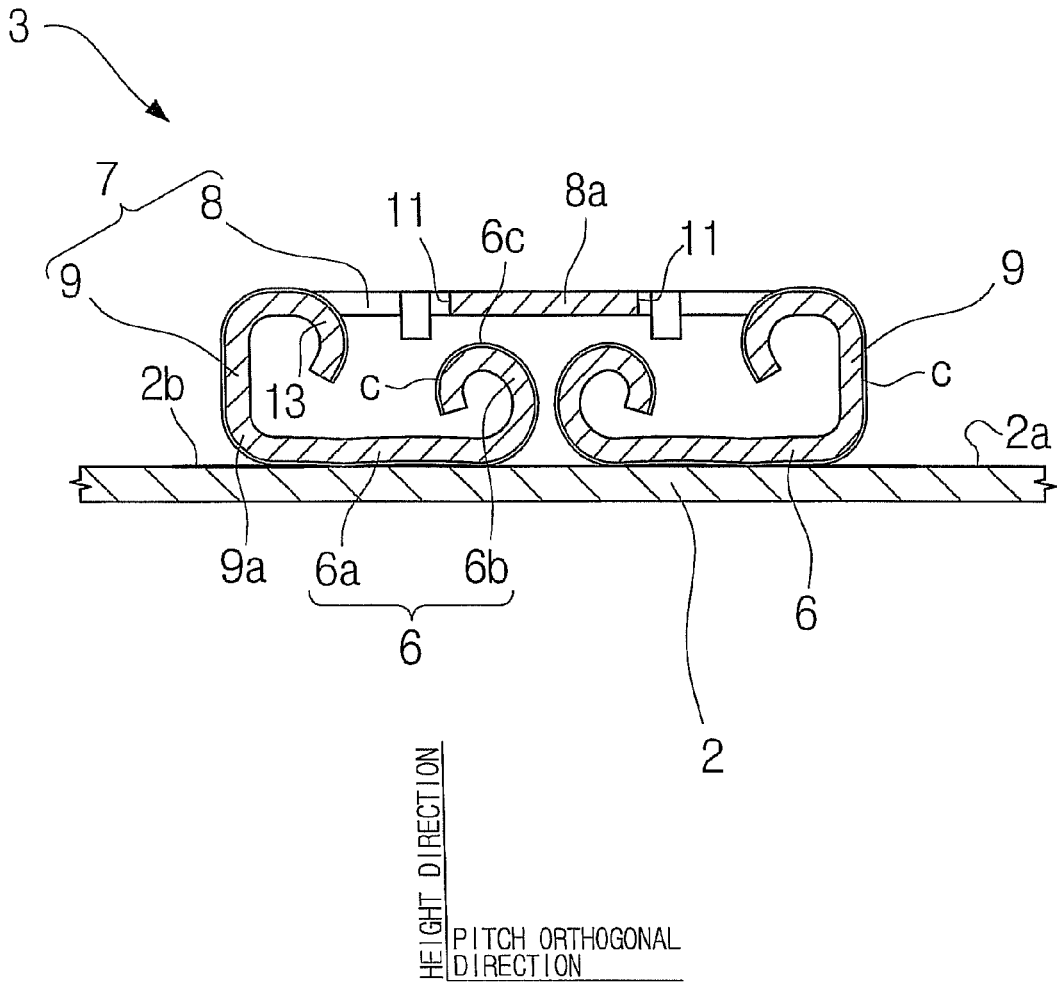
FIG. 4 is a cross-sectional view taken along the line IV-IV of FIG. 2.

As shown in FIGS. 2 to 4, the receptacle connector 3 includes a plurality of cantilevers arranged in a comb-like manner and functioning as a part of the contacts and an outer frame 7 that surrounds the plurality of cantilevers. As shown in FIG. 3, the plurality of cantilevers 6 are arranged in two rows along a direction parallel to a connector mounting surface of the receptacle substrate 2.

With reference to FIG. 3, a "pitch direction", "pitch orthogonal direction", and "height direction" are defined. The "pitch direction" is included in the direction parallel to a connector mounting surface 2*a* of the receptacle substrate 2 and also is a direction where a number of cantilevers 6 are arranged. Within the "pitch direction", a direction approaching to the center of the receptacle connector 3 is defined as a "pitch center direction", and a direction away from the center of the receptacle connector 3 is defined as a "pitch non-center direction". The "pitch orthogonal direction" is included in the direction parallel to the connector mounting surface 2*a* of the receptacle substrate 2 and also is a direction orthogonal to the pitch direction. Within the "pitch orthogonal direction", a direction approaching to the center of the receptacle connector 3 is defined as a "pitch orthogonal center direction", and a direction away from the center of the receptacle connector 3 is defined as a "pitch orthogonal non-center direction". The "height direction" is a direction orthogonal to the connector mounting surface 2*a* of the receptacle substrate 2. Within the "height direction", a direction approaching to the connector mounting surface 2*a* of the receptacle substrate 2 is defined as a "substrate approaching direction", and a direction away from the connector mounting surface 2*a* of the receptacle substrate 2 is defined as a "substrate away direction". Note that the "pitch direction", "pitch orthogonal direction", "height direction", and the like are applied also to the plug connector 5 as shown in FIG. 1.

(Outer Frame 7)

As shown in FIGS. 2 to 4, the outer frame 7 includes a top plate 7 and a pair of side plates 9.

(Outer Frame 7: Top Plate 8)

As shown in FIG. 3, the top plate 8 is disposed on the opposite side of the receptacle substrate 2 with the plurality of cantilevers 6 interposed therebetween and is substantially parallel to the receptacle substrate 2. The top plate 8 includes an insertion opening unit 10 for the plug connector 5 to be inserted. The insertion opening unit 10 is composed of a pair of insertion openings 11. Specifically, the pair of insertion openings 11 is formed in the top plate 8. In other words, the top plate 8 is formed to surround each of the insertion openings 11. The pair of insertion openings 11 is arranged along the pitch orthogonal direction. Each insertion opening 11 is elongated in the pitch direction. The top plate 8 has a continuous circumference 12 surrounding each insertion opening 11. A first curved part 13 that curves to hang in the substrate approaching direction and a pair of second curved parts 14 are formed to the circumference 12. The first curved part 13 is formed on the pitch orthogonal non-center direction side when viewed from the insertion openings 11. The pair of second curved parts 14 is formed on the pitch non-center direction side when viewed from the insertion openings 11. The first curved part 13 includes a first curved surface 13*a*. The second curved part 14 has a second curve surface 14*a*.

(Outer Frame 7: Side Plate 9)

As shown in FIG. 3, the pair of side plates 9 is disposed to sandwich the plurality of cantilevers 6 in the direction parallel to the connector mounting surface 2*a* of the receptacle substrate 2. The pair of side plates 9 are connected to an end in the pitch orthogonal direction of the top plate 8 and elongated in the substrate approaching direction. The pair of side plates 9 is substantially orthogonal to the receptacle substrate 2. As shown in FIG. 2, a hold down 15 for soldering the receptacle connector 3 to the receptacle substrate 2 is formed at a lower end in the pitch direction of each side plate 9. Each hold down 15 is connected to each side plate 9 and is bent toward the pitch orthogonal center direction from the side plate 9.

(Cantilever 6)

As shown in FIG. 4, each cantilever 6 extends away from the receptacle substrate 2. Specifically, the cantilever 6 is composed of a straight part 6*a*, which is connected to a lower end part 9*a* of each side plate 9 of the outer frame 7 and also extends in the pitch orthogonal direction, and a curved part 6*b*, which is connected to the straight part 6*a* and also curves toward the substrate away direction, the pitch orthogonal non-center direction, and the substrate approaching direction in order. This curved part 6*b* enables each cantilever 6 to extend away from the receptacle substrate 2. A top part 6*c* of the cantilever 6, which is the furthest from the receptacle substrate 2, is covered with the top plate 8. Specifically, the top part 6*c* of each cantilever 6 is covered with a top plate center part 8*a* as a part of the top plate 8 for separating the pair of insertion openings 11.

(Conductive Pattern c)

As shown in FIGS. 1 and 2, the plurality of conductive patterns c are formed on the receptacle connector 3 having the above configuration. Each conductive pattern c is formed to correspond to each cantilever 6. That is, the number of the cantilevers 6 is the same as that of the conductive patterns c.

As shown in FIGS. 3 and 4, each conductive pattern c is formed across each cantilever 6, the side plate 9, and the top plate 8. Specifically, each conductive pattern c is formed from a curved part 6*b* of each cantilever 6 to the first curved part 13 of the top plate 8. As shown in FIG. 4, each conductive pattern c is soldered to an electrode pad 2*b* formed on the connector mounting surface 2*a* of the receptacle substrate 2.

(Hold Down Pattern d)

As shown in FIG. 2, a plurality of hold down patterns d are formed on the receptacle connector 3. Each hold down pattern d is formed across each hold down 15 and the side plate 9. As each hold down pattern d is soldered to a pad for hold down 2*c* formed on the connector mounting surface 2*a* of the receptacle substrate 2, each hold down 15 is fixed to the receptacle substrate 2.

(Plug Connector 5)

Next, the plug connector 5 is explained with reference to FIGS. 1 and 5 to 10. In the plug connector 5 shown in FIG. 1, a metal plate M functions as a plurality of contacts by an insulating layer I formed on the metal plate M and a plurality of conductive patterns e formed on the insulating layer I. The plug connector 5 in this exemplary embodiment is formed as a so-called housingless connector not including a resin housing.

Figure 5:
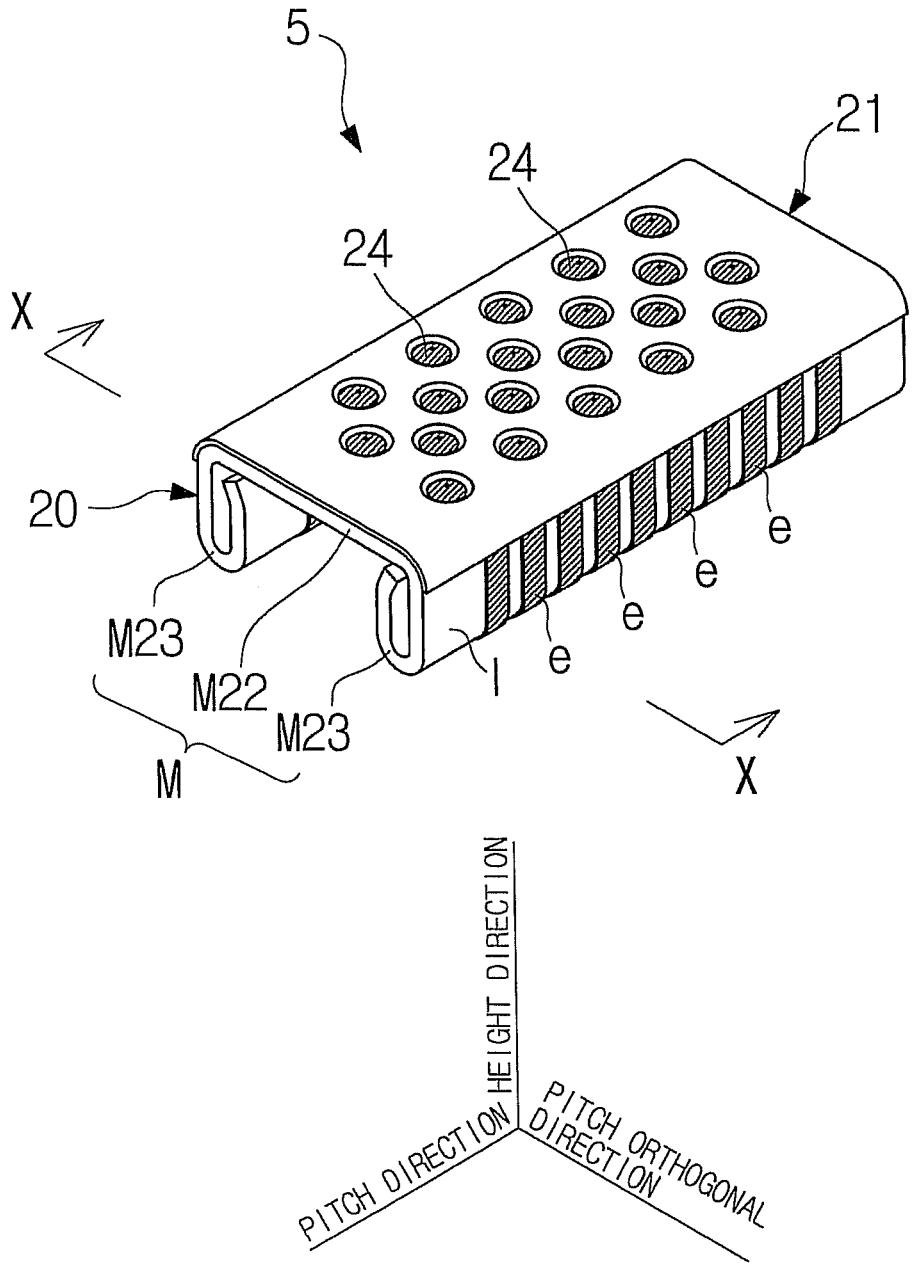
FIG. 5 is a perspective view of the plug connector according to the first exemplary embodiment.

Specifically, as shown in FIG. 5, the plug connector 5 is composed of a plug connector body 20 and an insulating sheet 21.

(Plug Connector Body 20)

The plug connector body 20 includes the metal plate M, the insulating layer I, and the plurality of conductive patterns e.

The metal plate M is composed of an opposing part M22 opposite to the plug substrate 4 and a pair of U-shaped parts M23.

Figure 6:
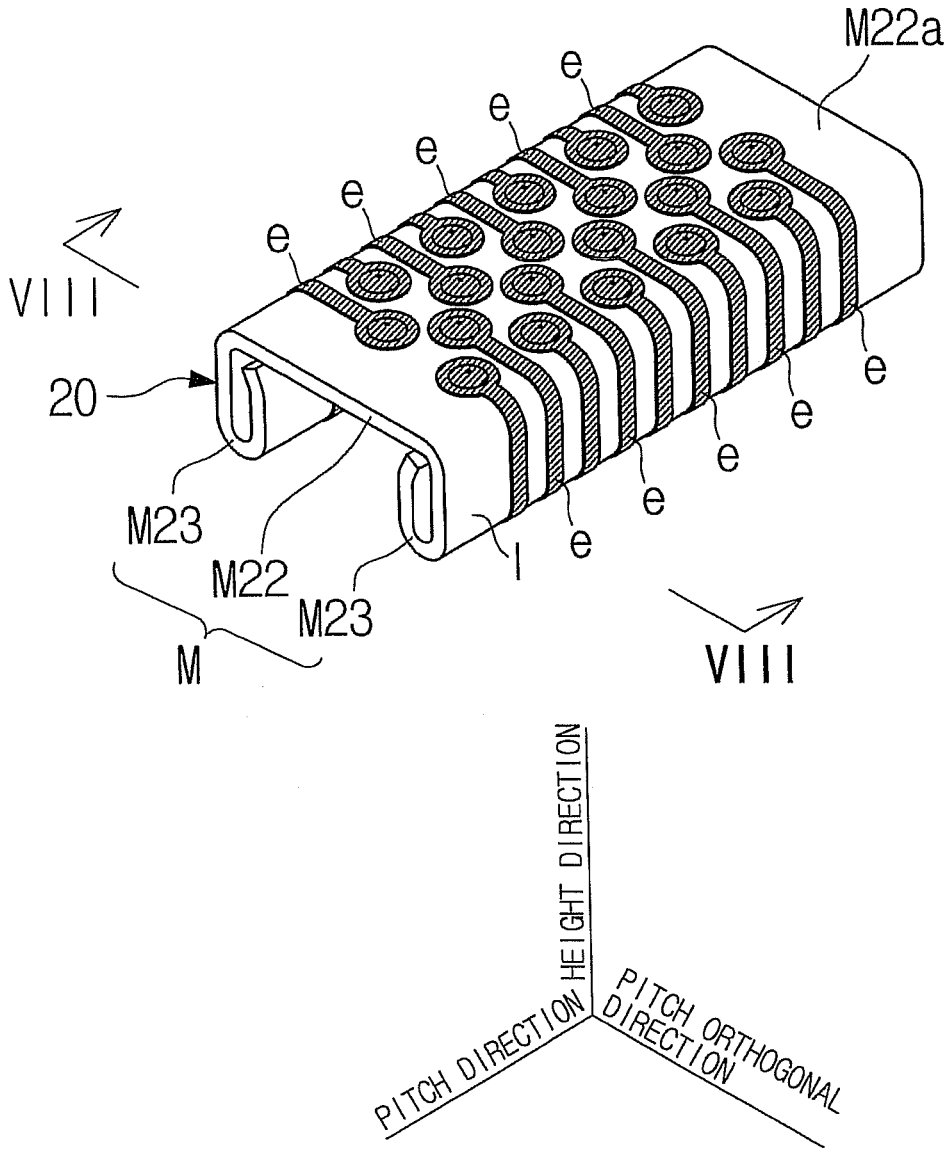
FIG. 6 is a perspective view of a state when an insulating sheet is removed from the plug connector according to the first exemplary embodiment.
Figure 7:
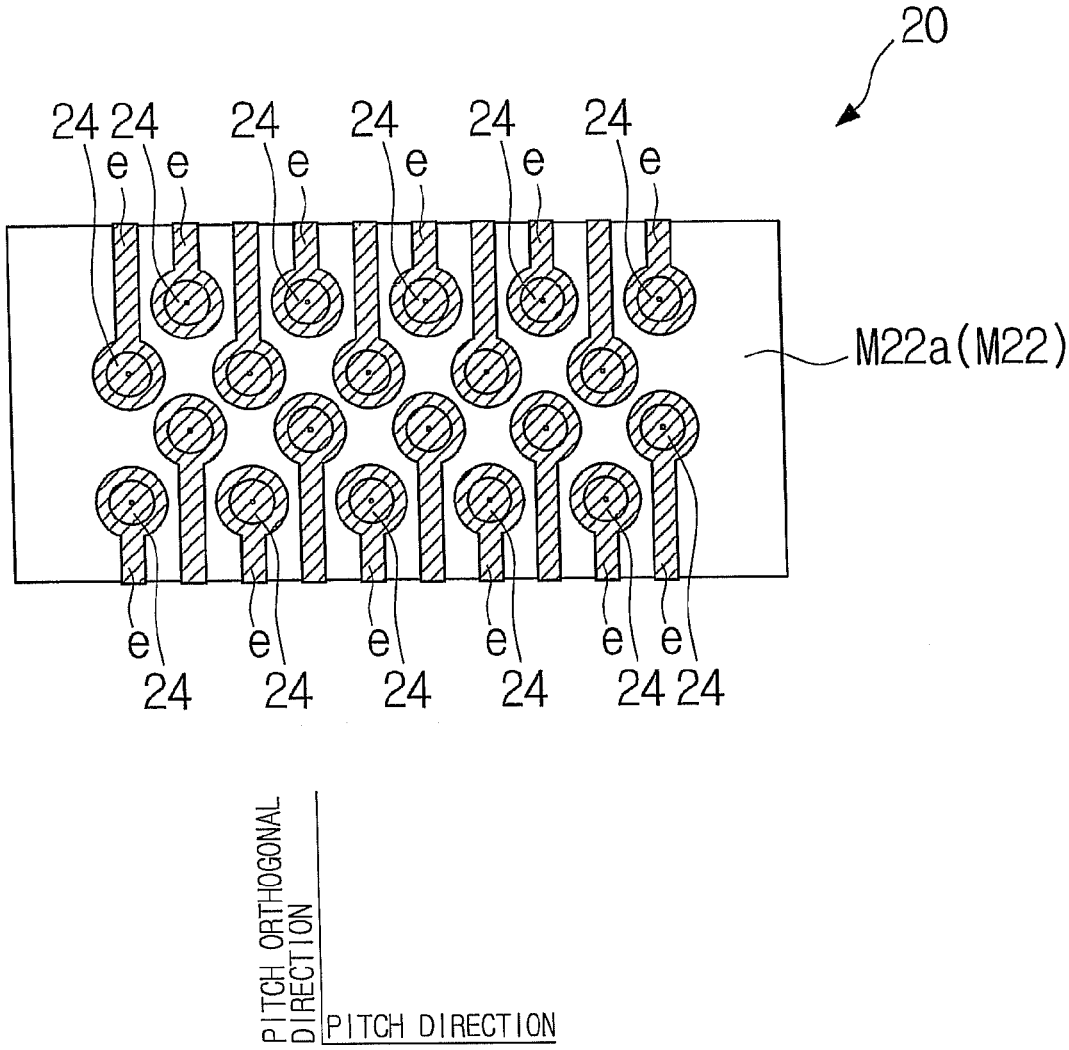
FIG. 7 is a plan view of a state when the insulating sheet is removed from the plug connector according to the first exemplary embodiment.
Figure 8:
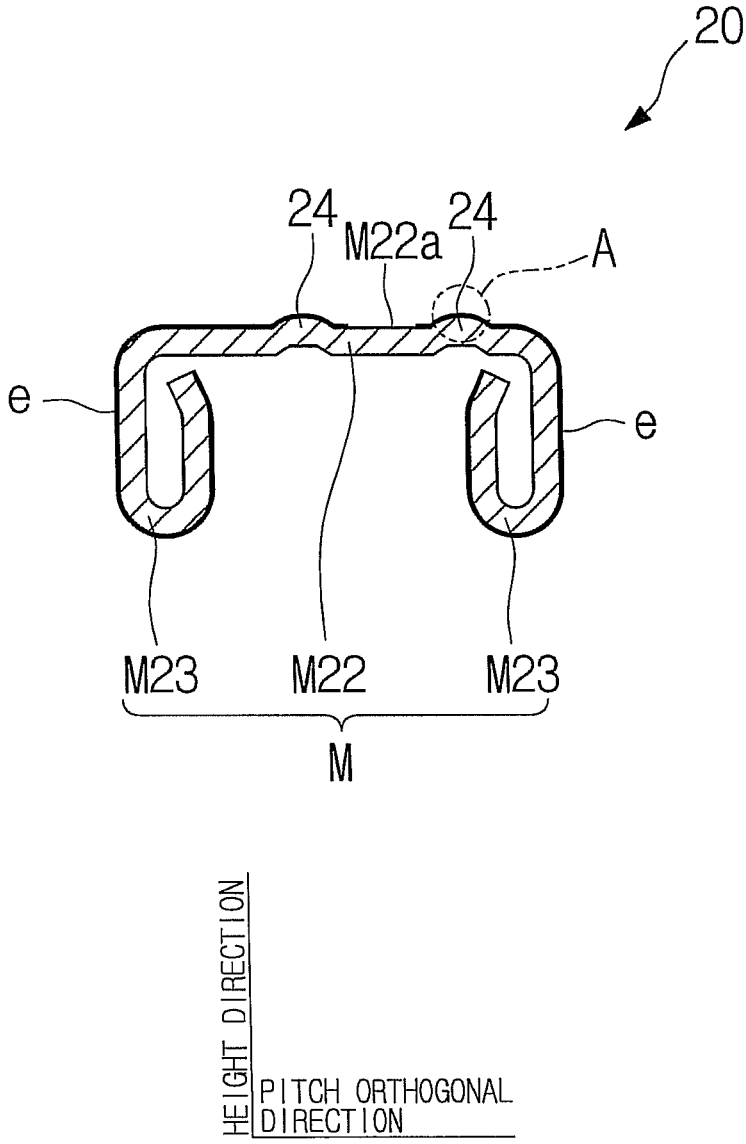
FIG. 8 is a cross-sectional diagram taken along the line VIII-VIII of FIG. 6.
Figure 9:
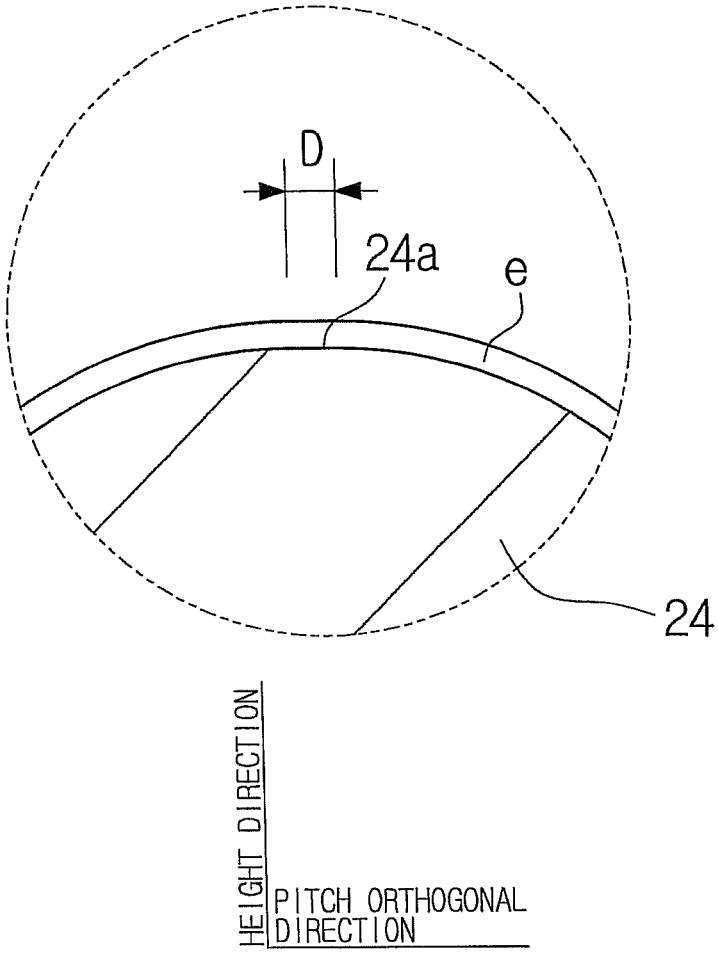
FIG. 9 is a diagram enlarging A part of FIG. 8 according to the first exemplary embodiment.

As shown in FIGS. 7 and 8, a plurality of protrusions 24 that protrude toward the plug substrate 4 are formed on a substrate opposing surface M22*a*, which is opposite to the plug substrate 4. Each protrusion 24 protrudes in a substantially spherical shape toward the plug substrate 4. Moreover, as shown in FIG. 9, a top part 24*a* of each protrusion 24 is formed to be substantially flat. Specifically, a substantially circular flat surface with a diameter D is formed on the top part 24*a* of each protrusion 24. Then, the plurality of protrusions 24 are arranged in a substantially staggered pattern, as shown in FIGS. 6 and 7.

As shown in FIGS. 5 and 6, each U-shaped part M23 extends from an end in the pitch orthogonal direction of the opposing part M22 in the substrate approaching direction (direction approaching the receptacle substrate 2, the same shall apply hereinafter), curves toward the pitch orthogonal center direction, and then formed in a substantially U-shape to extend in the substrate away direction (direction away from the receptacle substrate 2, the same shall apply hereinafter).

The insulating layer I is formed on the metal plate M. The insulating layer I is formed on the surface including the substrate opposing surface M22*a* between the two surfaces of the metal plate M. The insulating layer I is formed, for example, of polyimide or aramid. Instead, the insulating layer I may be formed as an oxide film of the metal plate M.

The plurality of conductive patterns e are formed on the insulating layer I. The plurality of conductive patterns e are electrically insulated from each other by the presence of the insulating layer between the plurality of conductive patterns e and the metal plate M. The plurality of conductive patterns e are formed to correspond to the plurality of cantilevers 6 (conductive pattern c) shown in FIG. 2. That is, the number of the conductive patterns e is same as that of the cantilevers 6 (conductive patterns c).

As shown in FIG. 8, each conductive pattern e is formed across one U-shaped part M23 and the opposing part M22. Moreover, each conductive pattern e extends to reach each protrusion 24 and formed to overlap the protrusion 24. As a result, at the opposing part M22, each conductive pattern e protrudes toward the plug substrate 4. Then, as shown in FIG. 10, each conductive pattern e is soldered to an electrode pad 4*b* on the connector mounting surface 4*a* of the plug substrate 4. Specifically, each conductive pattern e is soldered to the electrode pad 4*b* at each protrusion 24 on the connector mounting surface 4*a* of the plug substrate 4.

(Insulating Sheet 21)

As shown in FIGS. 5 and 6, the insulating sheet 21 covers the substrate opposing surface M22*a* of the opposing part M22 of the metal plate M. In other words, the substrate opposing surface M22*a* of the opposing part M22 of the metal plate M is coated with the insulating sheet 21. Specifically, the substrate opposing surface M22*a* of the opposing part M22 of the metal plate M is coated with the insulating sheet 21 except for the plurality of protrusions 24. In other words, in the state of FIG. 5, in which the substrate opposing surface M22*a* of the opposing part M22 of the metal plate M is coated with the insulating sheet 21, the plurality of protrusions 24 are exposed outside. Further, in the state of FIG. 5, in which the substrate opposing surface M22*a* of the opposing part M22 of the metal plate M is coated with the insulating sheet 21, the plurality of protrusions 24 sufficiently protrude toward the plug substrate 4 so that the plurality of protrusions 24 penetrate the insulating sheet 21 and protrude toward the plug substrate 4. The insulating sheet 21 is made, for example, of polyimide or aramid.

(Operation)

Next, an operation of the connector unit 1 is explained. First, as shown in FIG. 4, the receptacle connector 3 is mounted on the receptacle substrate 2, and as shown in FIG. 10, the plug connector 5 is mounted on the plug substrate 4. Next, as shown in FIG. 11, each U-shaped part M23 of the plug connector 5 is inserted into each insertion opening 11 of the receptacle connector 3. The first curved part 13 and the second curved part 14 formed on the circumference 12 of the insertion opening 11 facilitate insertion of the receptacle connector 3 into the insertion opening 11. At the time of inserting the U-shaped part M23 of the plug connector 5 into the insertion opening 11 of the receptacle connector 3, the U-shaped part M23 of the plug connector 5 pushes the curved part 6*b* of the cantilever 6 to the pitch orthogonal center direction. Then, each cantilever 6 firmly contacts with the U-shaped part M23 of the plug connector 5 by the self elastic restoring force. This contact realizes the conduction between each conductive pattern c of the receptacle connector 3 and each conductive pattern e of the plug connector 5.

(Manufacturing Method)

A manufacturing method of the receptacle connector 3 is explained here. First, an insulating layer is formed on one surface of the metal plate. Next, a desired conductive pattern c and hold down pattern d are formed on this insulating layer. Then, unnecessary parts are removed by a punching process, for example, and then a folding process is performed, and then the receptacle connector 3 as the one shown in FIG. 2 is completed.

Since the manufacturing method for the plug connector 5 is same as that for the receptacle connector 3, the explanation is omitted.

The first exemplary embodiment of the present invention has been explained above and features of the aforementioned first exemplary embodiment follows.

Specifically, the plug connector 5 (connector) is mounted on the plug substrate 4 (substrate) while making the metal plate M function as the plurality of contacts by the insulating layer I formed on the metal plate M and the plurality of conductive patterns e formed on the insulating layer I. The plurality of protrusions 24 that protrude toward the plug substrate 4 are formed on the substrate opposing surface M22*a*, which is opposite to the plug substrate 4 of the opposing part M22 of the metal plate M. The plurality of conductive patterns e are formed to respectively overlap the plurality of protrusions 24. Above configuration enables the plurality of conductive patterns e to be in contact explicitly with the plug substrate 4, thereby gives firm mounting of the plug connector 5 on the plug substrate 4. This eliminates short-circuit between the plurality of conductive patterns e and achieves narrow-pitch mounting.

Note that in this kind of connector, there has been no technical ideas to partially protrude the conductive pattern itself. This is because that in the ideas of related arts, mounting the conductive pattern as it is could generate short-circuit between adjacent terminals, and an insulating process performed to prevent the short-circuit between the adjacent terminals could cause a substrate mounting part not to be in contact with (cause the distance to be longer from) a connector mounting part, thereby leading to loose mounting. On the other hand, in this exemplary embodiment, the insulating process is performed and then the mounting part is protruded, thereby enabling the substrate mounting part to be in contact with (to be close to) the connector mounting part and achieving firm mounting.

Moreover, the substrate opposing surface M22*a* of the opposing part M22 of the metal plate M is coated to be insulated except for the plurality of protrusions 24. The above configuration effectively suppresses unintended short-circuit between adjacent conductive patterns e.

Further, the plurality of protrusions 24 are arranged in a staggered pattern. The above configuration allows each protrusion 24 to be formed with larger area.

Although the first exemplary embodiment of the present invention has been described as above, the first exemplary embodiment can be modified in the following way.

In the aforementioned first exemplary embodiment, the insulating sheet 21 is pasted on the opposing part M22 in order to coat the opposing part M22 to be insulated. Instead, the opposing part M22 may be coated to be insulated, for example by applying insulating paint and evaporating insulating material such as silicon oxide on the opposing part M22.

Moreover, in the aforementioned first exemplary embodiment, both the receptacle connector 3 and the plug connector 5 are so-called housingless connectors not including a resin housing. Instead, the receptacle connector 3 and the plug connector 5 may include the resin housing.

Second Exemplary Embodiment

Figure 12:
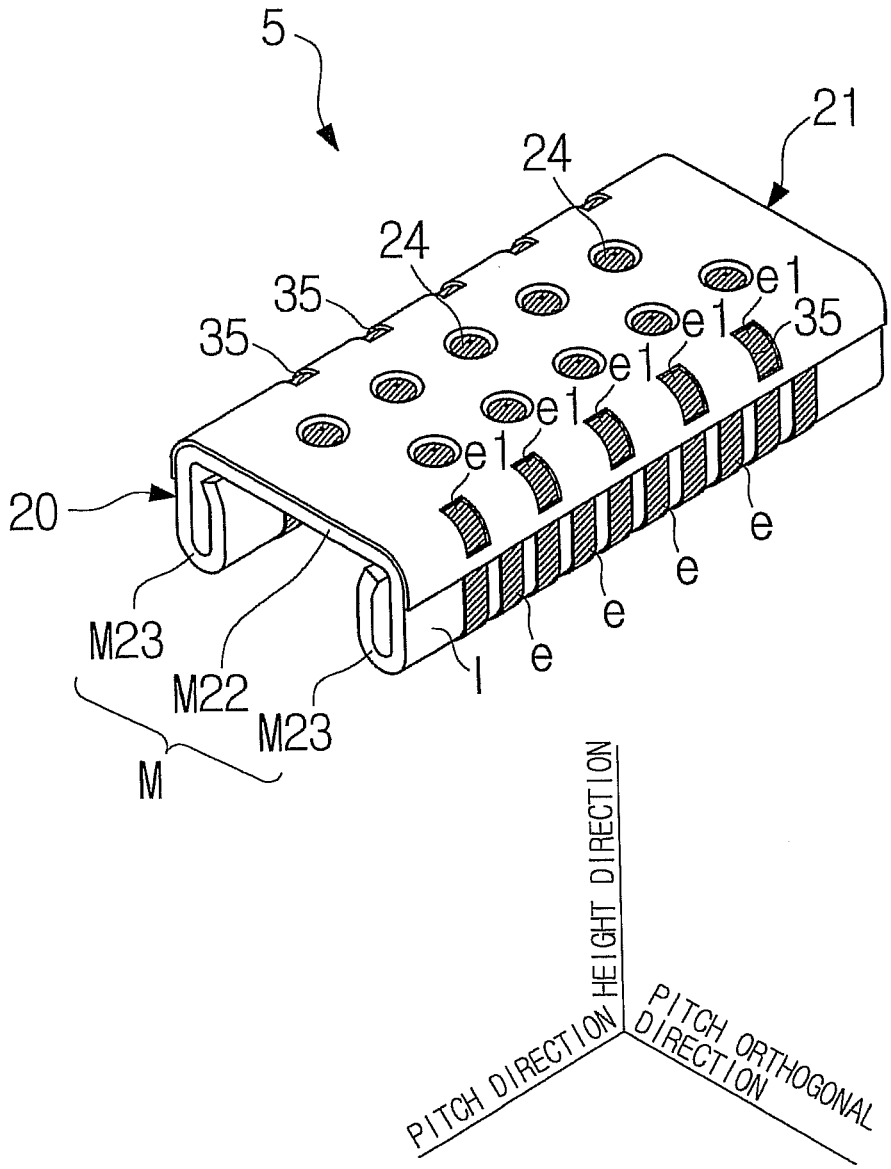
FIG. 12 is a perspective view of a plug connector according to a second exemplary embodiment.
Figure 13:
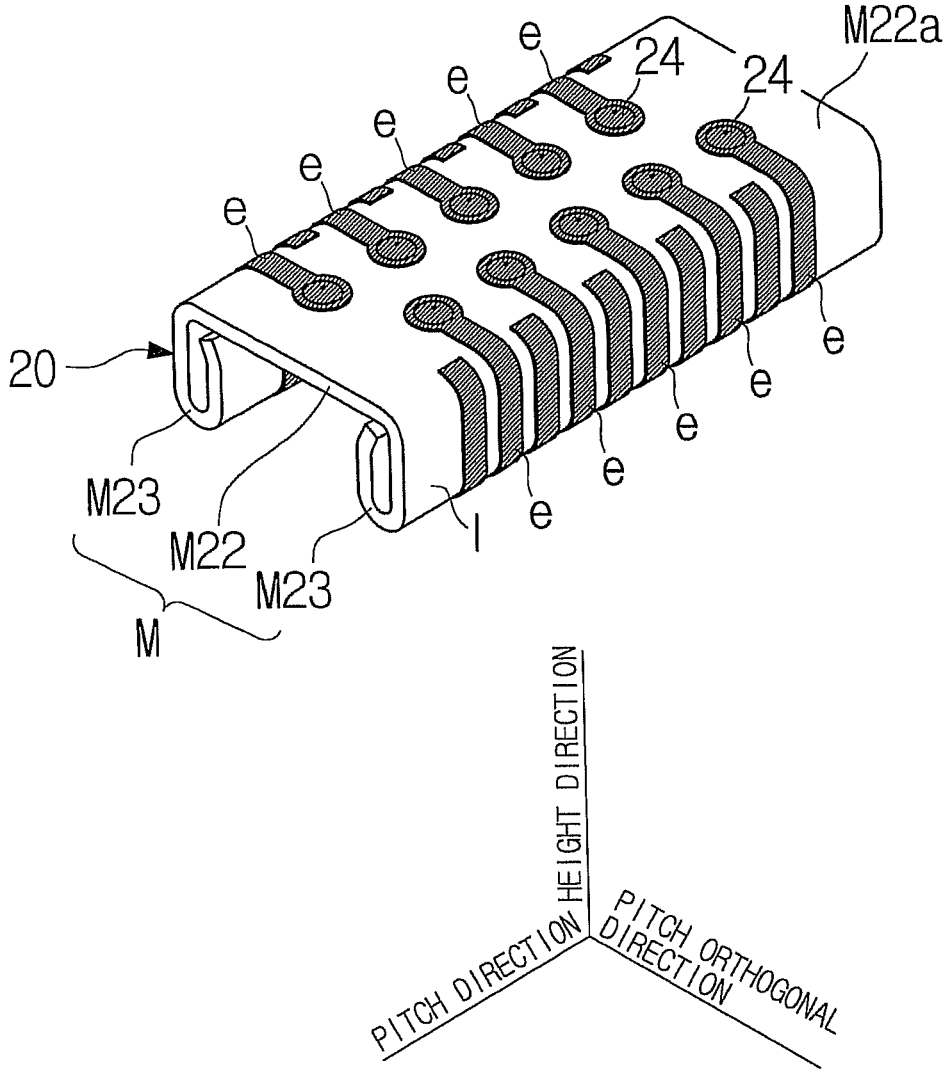
FIG. 13 is a perspective view of a state when an insulating sheet is removed from the plug connector.
Figure 14:
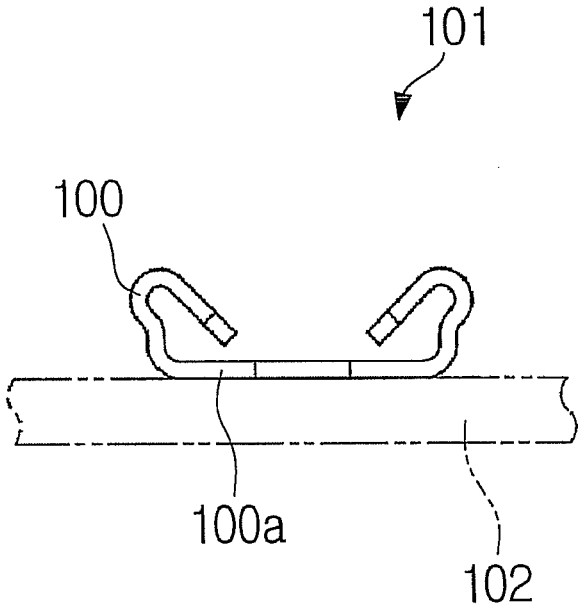
FIG. 14 is a diagram equivalent to FIG. 8 of Japanese Unexamined Patent Application Publication No. 2006-228612.

Next, a second exemplary embodiment of the present invention is explained with reference to FIGS. 12 and 13. Differences of this exemplary embodiment from the first exemplary embodiments are focused here, and the explanation will not be repeated as appropriate. Additionally, as a general rule, components corresponding to the components in the above first exemplary embodiment are denoted by the same reference numerals.

In the plug connector 5 according to this exemplary embodiment, the plurality of protrusions 24 that protrude toward the plug substrate 4 are formed on the substrate opposing surface M22*a* of the opposing part M22. The number of the protrusions 24 is half the number of the conductive patterns e. The plurality of protrusion 24 are arranged in a substantially staggered pattern. Further, half of the conductive patterns e among the plurality of conductive patterns e are formed to overlap each protrusion 24. As a result, on the opposite part M22, half of the conductive patterns e among the plurality of conductive patterns e protrude toward the plug substrate 4 side. Then, the plurality of conductive patterns e are soldered to the electrode pads 4*a* on the connector mounting surface 4*a* of the plug substrate 4. Specifically, half of the conductive patterns e are soldered to the electrode pads 4*b* on the connector mounting surface 4*a* of the plug substrate 4 at each protrusion 24. Moreover, remaining half of the conductive patterns e among the plurality of conductive patterns e are soldered to the electrode pads 4*b* on the second curved surface 14 of the plug substrate 4 at the curved part e1 that curves in the boundary between the opposing part M22 and the U-shaped part M23 of the metal plate. Note that a soldering window part 35 for exposing the curved part e2 outside is formed in the insulating sheet 21.

Although the first and second exemplary embodiments of the present invention have been described, the first and second exemplary embodiments can be modified as explained below.

Specifically, although in the first and second exemplary embodiments, the protrusions 24 are formed on the plug connector 5, the protrusions 24 may be formed also on the receptacle connector 3. Moreover, although it is preferable to form the same number of protrusions 24 as that of the conductive patterns e (or conductive patterns c), it is not necessarily the same. For example, one conductive pattern e may be configured to overlap two or more protrusions 24. This enables one conductive pattern e to be in contact with the plurality of electrode pads 4*b* at the same time that are formed on the connector mounting surface 4*a* of the plug substrate 4.

From the invention thus described, it will be obvious that the exemplary embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector that is mounted on a substrate while making a metal plate have a plurality of contacts by an insulating layer formed on the metal plate and a plurality of conductive patterns formed on the insulating layer, wherein the metal plate comprises a protrusion that protrudes toward the substrate, and any one of the plurality of the conductive patterns overlaps the protrusion to protrude toward the substrate, and the substrate opposing surface is coated to be insulated except for the protrusion, the substrate opposing surface being opposite to the substrate.

2. The connector according to claim 1, wherein a plurality of the protrusions are formed, and the plurality of protrusions are arranged in a staggered pattern.

3. The connector according to claim 1, wherein the protrusion protrudes in a substantially spherical shape.

4. The connector according to claim 3, wherein a top part of the protrusion is formed to be substantially flat.

5. A connector that is mounted on a substrate while making a metal plate have a plurality of contacts by an insulating layer formed on the metal plate and a plurality of conductive patterns formed on the insulating layer, wherein the metal plate comprises a plurality of protrusions that protrude toward the substrate, and the plurality of conductive patterns respectively overlap the plurality of protrusions to protrude toward the substrate, and the substrate opposing surface is coated to be insulated except for the plurality of protrusions, the substrate opposing surface being opposite to the substrate.

6. The connector according to claim 5, wherein the plurality of bugled parts are arranged in a staggered pattern.

* * * * *